US009593803B1

(12) United States Patent
Roddenberry

(10) Patent No.: US 9,593,803 B1
(45) Date of Patent: Mar. 14, 2017

(54) HANGER SYSTEM AND METHOD

(71) Applicant: Jeffrey Scott Roddenberry, Gulf Breeze, FL (US)

(72) Inventor: Jeffrey Scott Roddenberry, Gulf Breeze, FL (US)

( * ) Notice: Subject to any disclaimer, the term of this patent is extended or adjusted under 35 U.S.C. 154(b) by 0 days.

(21) Appl. No.: 14/201,809

(22) Filed: Mar. 8, 2014

(51) Int. Cl.
*E04G 3/00* (2006.01)
*F16M 13/02* (2006.01)

(52) U.S. Cl.
CPC ..... *F16M 13/02* (2013.01)

(58) Field of Classification Search
CPC ..... F16M 13/02
USPC ..... 248/290.1
See application file for complete search history.

(56) References Cited

U.S. PATENT DOCUMENTS 633,909 A * 9/1899 Sandford ..... 248/217.4
5,692,716 A * 12/1997 Himmelsbach ..... F41B 5/14 135/16
5,857,651 A * 1/1999 Kunevicius ..... 248/230.8
5,967,475 A * 10/1999 Johnson ..... 248/217.4
6,364,267 B1 * 4/2002 Pearce ..... 248/304
6,478,272 B1 * 11/2002 McKinsey et al. ..... 248/216.1
6,726,162 B1 * 4/2004 Winter ..... 248/218.4
7,789,607 B2 * 9/2010 Fuest ..... F16B 35/06 411/383
7,861,987 B2 * 1/2011 Gorsuch ..... F41A 23/18 124/86
8,231,095 B2 * 7/2012 Bean ..... 248/323
8,695,253 B2 * 4/2014 Bednarksi ..... 40/607.13
2013/0082153 A1 * 4/2013 Palen ..... F16L 3/003 248/75
2013/0134268 A1 * 5/2013 Wessells ..... F16B 17/00 248/125.8
2014/0101913 A1 * 4/2014 Roddenberry ..... 29/428

* cited by examiner

*Primary Examiner* — Kristina Junge
(74) *Attorney, Agent, or Firm* — J. Nevin Shaffer, Jr.

(57) ABSTRACT

A hanger system and method consists of a base mount with a connection device conformed to connect with a separate object. The base mount further includes a mounting stud. An outer receiver head is provided with a quick connect female receiver conformed to connect with and disconnect from the mounting stud and when connected with the mounting stud to secure the connection in place and the outer receiver head includes a performance device.

15 Claims, 3 Drawing Sheets

HANGER SYSTEM AND METHOD

CROSS REFERENCE TO RELATED APPLICATION

This application claims the benefit of previously filed U.S. provisional patent application No. 61/851,489 filed Mar. 8, 2013 for a "Hanger System and Method". The Applicant hereby claims the benefit of this provisional application under 35 U.S.C. §119. The entire content of this provisional application is incorporated herein by this reference.

FIELD OF THE INVENTION

This invention relates to a hanger system and method. In particular, in accordance with one embodiment, the invention relates to a hanger system consisting of a base mount with a connection device conformed to connect with a separate object. The base mount further includes a mounting stud. An outer receiver head is provided with a quick connect female receiver conformed to connect with and disconnect from the mounting stud and when connected with the mounting stud to secure the connection in place and the outer receiver head includes a performance device.

BACKGROUND OF THE INVENTION

A problem exists with regard to the use of equipment in remote locations or locations that are not designed to support or accommodate equipment. For example only and not by way of limitation, hunters take equipment, such as guns, bows and arrows, cameras and the like, into the woods. Once there, the problem is how and where to store the equipment before, after and during use.

The industry is replete with devices called "hanger products" designed to remedy these problems. Conventional hanger products are, again, primarily used in the field of hunting, again for example only. Also known as tree accessories, they are preferred by sportsmen who hunt from tree stands or other elevated posts. Hanger products are applied to trees by either a "screw-in", or "strap-to" attachment mode. Once installed, they serve as a hands-free support in which to position essential gear. Considered accessory equipment, hanger products are devised for use with primary hunting gear. Examples of primary gear include: guns, bows, cameras, etc., while accessory hangers consist of products such as: shooting rests, bow hangers, and camera mounts, etc. Sporting goods companies produce each class of product in an array of styles and sizes, so that each unique version may distinctly position gear.

However, each particular version has its own drawbacks regarding installation and the location of gear. For example, the installation of screw style products prove laborious because they require a manual start and drive to the screw, while the installation of strap style products prove cumbersome due to their bulky designs. Once installed, the ability to position equipment is limited by the predetermined length and strict working style prescribed by each design. This lack of flexibility is often problematic for achieving different tree set-ups and orientations. That is, prior art devices come in various sizes but are not interchangeable such that a user is required to bring multiple devices in order to accommodate unknown circumstances. That is, a tree limb may dictate a longer or shorter hanger so both the long and short and intermediate hanger must be carried to be certain to get the proper set up for each situation.

Further once a user manages to get them installed there is a strong reluctance to remove them. Thus, prior art devices, which may be expensive, are often left in place and become subject to damage from the environment or theft.

Prior art devices, again, are complete sets for the most part. Applicant, however, is aware that some prior art devices come in two parts: a base and a hanger, for example. However, the two parts are unique to each other and can not receive other parts or pieces as may be desired or required.

Thus, there is a need in the art for a hanger system that is versatile and modifiable to accommodate any particular requirements of a specific location, that is easy to assemble and disassemble, that is inexpensive in its separate elements and, when desired, that leaves exposed only a single part when left in place.

It therefore is an object of this invention to provide a hanger system and method that is economical, versatile, interchangeable and easy to use.

SUMMARY OF THE INVENTION

Accordingly, the hanger system and method of the present invention, according to one embodiment, includes a base mount with a connection device conformed to connect with a separate object. The base mount further includes a mounting stud. An outer receiver head is provided with a quick connect female receiver conformed to connect with and disconnect from the mounting stud and when connected with the mounting stud to secure the connection in place and the outer receiver head includes a performance device.

All terms used herein are given their common meaning such that a "quick connect" device is one that enables a user to make a mechanical connection swiftly. These devices include movable covers that allow a male shaft to be received and then trapped by ball bearings when the cover is released. Further, they maintain the connection securely until operated in reverse, all as are known in the art or may be developed hereafter.

In one aspect of the system, the base mount is selected from a group consisting of: a screw in base mount and a strap to base mount.

As used herein a "screw in base mount" describes a base mount that is attached by screws in some form or fashion and a "strap to" base mount describes a base mount that is attached by straps.

In one aspect, the outer receiver head includes a performance device selected from a group consisting of: a bow hanger, a gear hook and a quiver holder.

As used herein a "bow hanger" describes a device from which a bow is supported; a "gear hook" describes a device from which gear such as cameras, coats, bags, etc., for example only, is hung; and a "quiver holder" describes a device for holding an arrow quiver and a selection of arrows as well if present.

In another aspect, the bow hanger includes a hook that rotates from zero to three hundred sixty degrees and in another aspect, the bow hanger includes single, double or triple hooks.

In one aspect, the invention further includes a central link with a movable quick connect female receiver conformed to connect with and disconnect from the mounting stud and when connected with the mounting stud to secure the connection in place and, further, where the central link includes at least one mounting stud conformed to connect with the outer receiver head movable quick connect female receiver.

In a further aspect, the central link includes a first mounting, stud and a second mounting stud where the first mounting stud is located between the central link movable quick connect female receiver and the second mounting stud and where the outer receiver head movable quick connect female receiver is connected with the second mounting stud.

In one aspect, a performance device is connected with the central link first mounting stud.

In another aspect, the invention further includes a plurality of central links where one central link is connected with the base mount mounting stud and with another central link and where one central link is connected with the outer receiver head and with either the central link connected with the base mount mounting stud or another central link.

According to another embodiment, a hanger system comprises a base mount with a connection device conformed to connect with a separate object and where the base mount further includes a mounting stud where the base mount is selected from a group consisting of: a screw in base mount and a strap to base mount. An outer receiver head is provided with a movable quick connect female receiver conformed to connect with and disconnect from a mounting stud and when connected with the mounting stud to secure the connection in place and where the outer receiver head includes a performance device. A central link is provided with a movable quick connect female receiver conformed to connect with and disconnect from the base mount mounting stud and when connected with the base mount mounting stud to secure the connection in place and where the central link includes at least one mounting stud conformed to connect with the outer receiver head movable quick connect female receiver.

In another aspect of this invention, the central link includes a first mounting stud and a second mounting stud where the first mounting stud is located between the central link movable quick connect female receiver and the second mounting stud and where the outer receiver head movable quick connect female receiver is connected with the second mounting stud.

In one aspect, a performance device is connected with the central link first mounting stud.

In another aspect, the invention further includes a plurality of central links where one central link is connected with the base mount mounting stud and with another central link and where one central link is connected with the outer receiver head and with either the central link connected with the base mount mounting stud or another central link.

In a further aspect, the outer receiver head includes a performance device selected from a group consisting of: a bow hanger, a gear hook and a quiver bracket.

In one aspect, either the central link or the outer receiver head includes an inner primary arm and an outer secondary arm where the outer secondary arm surrounds the inner primary arm and is movable to an extended position in which the inner primary arm is exposed and further where the outer secondary arm includes the performance device.

According to another embodiment, a hanger method consists of:

a. providing a base mount with a connection device conformed to connect with a separate object and where the base mount further includes a mounting stud; and an outer receiver head with a movable quick connect female receiver conformed to connect with and disconnect from the mounting stud and when connected with the mounting stud to secure the connection in place and where the outer receiver head includes a performance device; and b. attaching the base mount connection device to the separate object.

In one aspect, the method further includes a central link with a movable quick connect female receiver conformed to connect with and disconnect from the base mount mounting stud and when connected with the base mount mounting stud to secure the connection in place and where the central link includes at least one mounting stud conformed to connect with the outer receiver head movable quick connect female receiver.

In another aspect, the central link includes a first mounting stud and a second mounting stud where the first mounting stud is located between the central link movable quick connect female receiver and the second mounting stud and where the outer receiver head movable quick connect female receiver is connected with the second mounting stud.

In one aspect, the method further includes a plurality of central links where one central link is connected with the base mount mounting stud and with another central link and where one central link is connected with the outer receiver head and with either the central link connected with the base mount mounting stud or another central link.

In another aspect, the outer receiver head includes a performance device selected from a group consisting of: a bow hanger, a gear hook and a quiver bracket.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
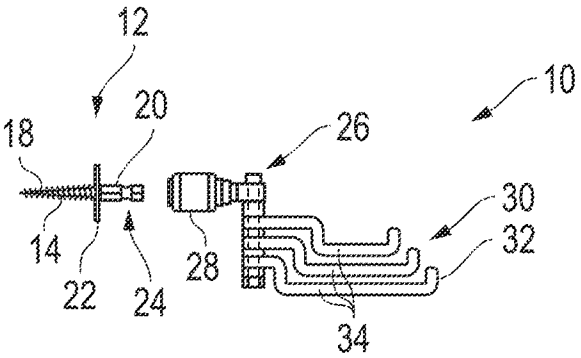
FIG. 1 is a side view of the hanger apparatus showing a screw in base mount and an outer receiver head.
Figure 2:
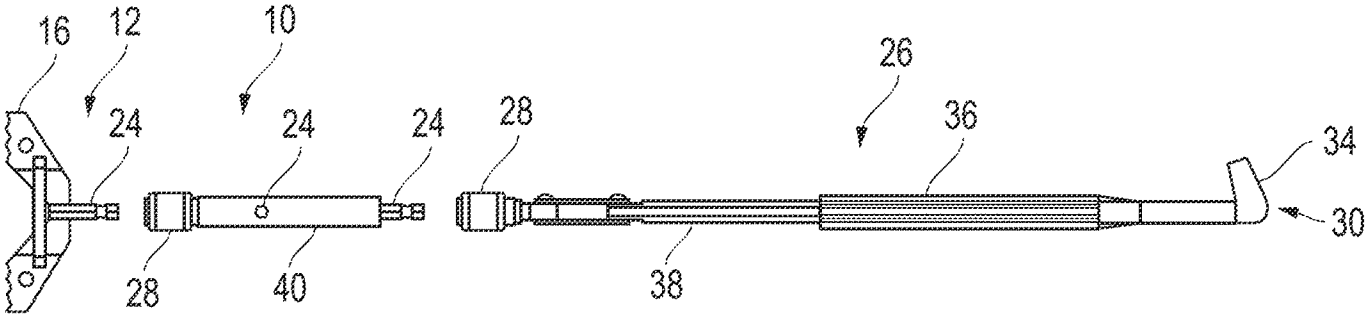
FIG. 2 is a side view of the hanger apparatus showing a strap to base mount, a central link and an outer receiver head with an inner primary arm and an outer secondary arm where the outer secondary arm surrounds the inner primary arm and is shown moved to an extended position in which the inner primary arm is exposed.

The preferred embodiment of the present invention is illustrated by way of example in FIGS. 1-5. With specific reference to FIGS. 1 and 2, a hanger system 10 includes a base mount 12. FIG. 1 shows base mount 12 in the form of a screw in base mount 14 and FIG. 2 shows base mount 12 in the form of a strap to base mount 16.

Screw in base mount 14 may be any type of screw in base mount now known or hereafter developed, however, Applicants believes the preferred embodiment is achieved by use of the mountable attachment described in his co-pending U.S. patent application Ser. No. 13/573,883 incorporated by reference herein. In that application it is disclosed that the mountable attachment, for the purposes of this application the screw in base mount 14, includes an at least partially threaded, tapered, attachment shaft 18 connected with a combination headless drive shaft-hang shaft 20 with, preferably a stability plate 22 in-between. For the purposes of this invention, again, any screw in base mount 14 now known or hereafter developed is included within its scope so long as it includes a mounting stud 24.

Here again, Applicant prefers a mounting stud 24 as described in his co-pending application which includes the drive shaft portion and the hang shaft portion as described and illustrated. A "mounting stud" is a device to which other objects may be attached. In the preferred embodiment, the mounting stud is a "male" member which extends outwardly from the base mount 14 as illustrated and is of a singular design where ever it is used in the present invention. That is, each mounting stud 24 is the same as all other mounting studs 24.

Strap to base mount 16 is secured in place to a tree (not shown) for example by straps (not shown) as is known in the art. Many places and people desire to avoid attaching devices to trees or other strictures by nails or screws and thus require or prefer strap to base mounts 16.

Outer receiver head 26 includes a quick connect female receiver 28 conformed to connect with and disconnect from a mounting stud 24 and when connected with a mounting stud 24 to secure the connection in place. Outer receiver head 26 as illustrated in FIG. 1 includes a performance device 30 in the form of a hanger 32 with three separate hooks 34. In FIG. 2, performance device 30 includes a single hook 34 attached to an outer secondary arm 36. Secondary arm 36 surrounds and encases inner primary arm 38 and is movable to an extended position as shown in FIG. 2 in which the inner primary arm 38 is exposed. By means of this aspect of the present invention, a user has the ability to precisely locate the performance device 30, either closer to or farther away, in relation to his position with the base mount 12. This is a distinct advantage over the prior art which requires separate short, medium and long systems.

Still referring to FIG. 2, another important aspect of the invention is disclosed in the form of a central link 40 with a movable quick connect female receiver 28 conformed to connect with and disconnect from a mounting stud 24 and when connected with the mounting stud 24 to secure the connection in place. Central link 40 includes at least one mounting stud 24 conformed to connect with outer receiver head 26 movable quick connect female receiver 28 or any movable quick connect female receiver 28.

Figure 3:
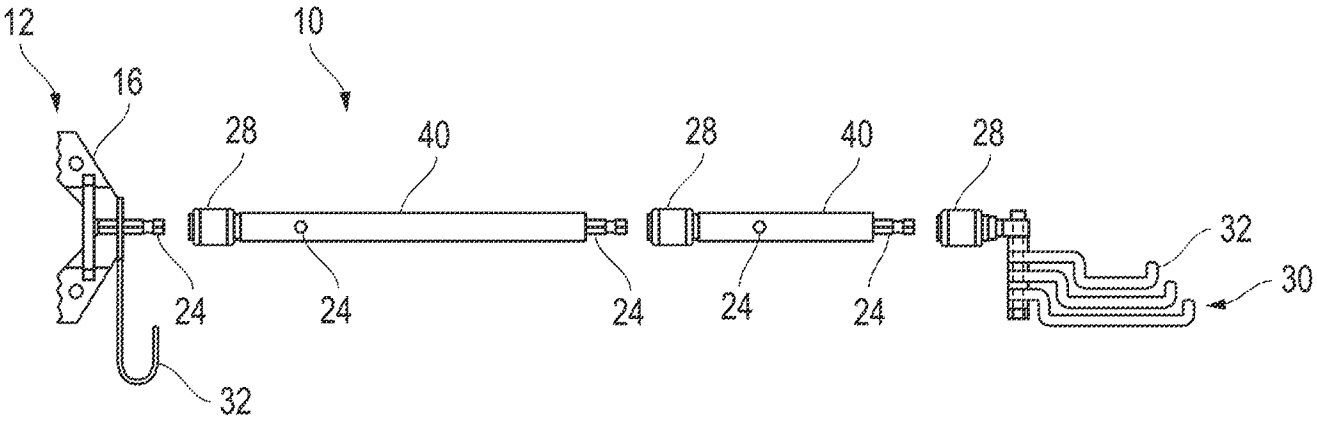
FIG. 3 is a side view of the invention of FIG. 2 showing multiple central link sections.

By means of central link 40 any desired length of hanger system 10 is possible. That is, any central link 40 can be attached to any mounting stud 24 and any quick connect female receiver 28 can be connected to the mounting stud 24 on central link 40. In FIG. 2, central link 40 is connected with the mounting stud 24 on strap to mount 16 with quick connect female receiver 28 attached to and connected with mounting stud 24 on one end. On the other end, the mounting stud 24 on central link 40 is used to connect with the quick connect female receiver 28 on the outer receiver head 26 as shown. As will be discussed more fully hereafter, FIG. 3 illustrates two central links 40 connected to each other in the same way prior to connection with the outer receiver head 26. In sum, however, any set up can be achieved by mixing and matching the elements of Applicant's invention. These elements are easy to transport and assemble and save the user from having to buy complete sets of different sizes as required currently.

Referring, now to FIG. 3, another aspect of the invention is illustrated in which a performance device 30 in the form of a gear hook 42 is shown placed over mounting stud 24 of strap to base mount 16. Thereafter, central link 40 is connected with mounting stud 24 on the base mount 16 thereby trapping gear hook 42 in place. This illustrates another feature of performance devices 30 in that they may be connected in locations other than the outer receiver head 26. Gear hook 42 is a hook from which gear such as cameras, binoculars, and the like may be hung.

Figure 4:
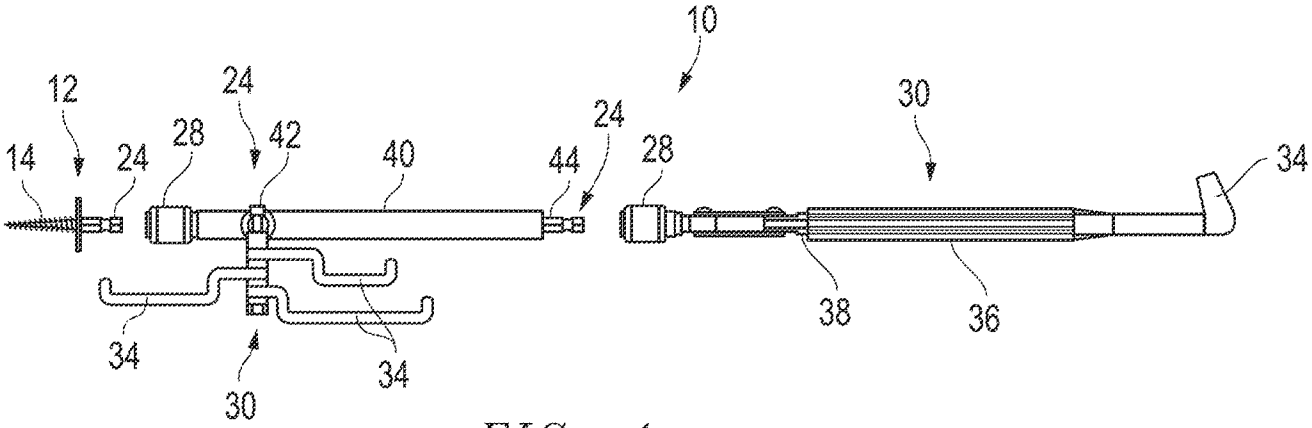
FIG. 4 is a side view of the invention of FIG. 1 showing the outer secondary arm moved to a retracted position in which most of the inner primary arm is covered.

Referring now to FIG. 4, another aspect of the invention is illustrated in which central link 40 includes a first mounting stud 42 and a second mounting stud 44. First mounting stud 42 is located between quick connect female receiver 28 and second mounting stud 44 as shown. Quick connect female receiver 28 on central link 40 connects, in FIG. 4, with mounting, stud 24 of screw in base mount 14. As before, quick connect female receiver 28 on outer receiver head 26 connects with second mounting stud 44 on central link 40. The presence of first mounting stud 42, however, provides an additional location for the attachment of any performance device 30. FIG. 4 illustrates the attachment of hanger 32 with three separate hooks 34. It is also illustrated that hooks 34 are, according to one aspect of the invention, moveable from zero to three hundred and sixty degrees.

FIG. 4, as mentioned above, also illustrates an outer receiver head 26 with an inner primary arm 38 and an outer secondary arm 36 shown in the retracted or collapsed position with the outer secondary arm 36 surrounding and covering most of the inner primary arm 38.

Figure 5:
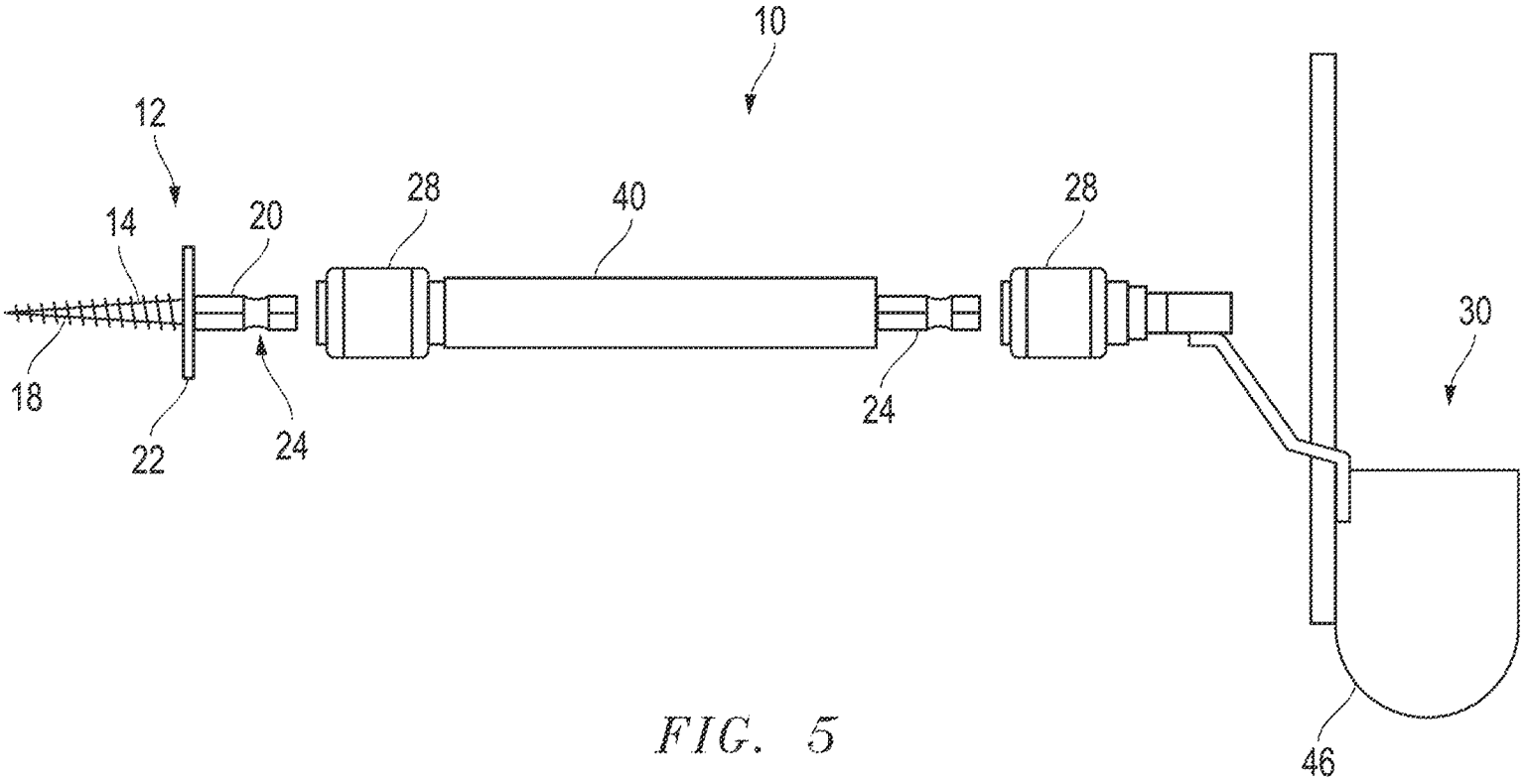
FIG. 5 is a side view of the invention of FIG. 1 with a performance device in the form of an arrow quiver holder.

Referring, to FIG. 5, another performance device 30 is shown in the form of a quiver holder 46. Quiver holder 46 is connected with outer receiver head 26 which is connected with central link 40 which is connected with screw in base mount 14 as previously described. Certainly, it should be clear by now that any form of performance device 30 may be adopted for use within the scope of the present invention. Further it should be understood that central link 40 may be any length or dimension and may include the inner primary arm 38 and outer secondary arm 36 configuration as described above. Likewise, any number of mounting studs 24 may be present along the length of central link 40 or outer receiver head 26.

By way of further description, Applicant's hanger system is a multi-section, quick-connection, tree accessory product, for example only. The system features a universal design that incorporates a diverse selection of hanger component-parts. Each specialized part is engineered with quick-release technologies which allow for divisional hanger sections to be readily interchanged. Quick-change parts include: base mounts of both screw and strap-to style, central converter pipes (central links 40) of variant length, and an assortment of high performance product heads. Certain components, such as the quick-release screw, can also be accepted by a variety of standard, powered, and ratchet styled tools.

Unlike structurally set hangers of conventional form, Applicant's hanger system allows for an impromptu choice in styles, lengths, and methods for which it can be applied. In other words, this small, yet diverse, system enables the hunter, for example only, to create a desired hanger version regardless of the tree orientation.

Applicant's base mount components permit installation methods unheard of in the industry today. The detachable designs encourage the use of mechanical tools, while allowing hunters the option to pre-set countless trees. This unique concept not only quickens primary installation but promotes a convenient "plug-in", "plug-out" connective method for returning hunts thereafter.

Given the above performance parameters, manufacturers typically produce each class of product in an array of styles and sizes. The wide performance curve, however, results in the creation in the prior art of a specific hanger version for each distinctive setup or tree orientation. However, this means that the user the needed to carry an assortment of hangers to the field which often burdensome and takes up much needed space in the hunter's pack. In addition, purchasing several variations of a particular product can become costly.

By comparison, Applicant's hanger system provides the only design that's integrated with quick-release capabilities throughout each sectional part. Quick-change parts include: base mounts of both screw and strap-to style, central converter pipes of variant length, and an assortment of high performance product heads. Each quick-release component is advantageous for set-up because it first allows the hunter to select a preferred method for installation. It then permits the hunter to modify the hanger's overall length, as well as convert the hanger to receive a desired form of primary gear. In short, the hanger system of the present invention can be modified to create hanger versions of most any standard form. The system also permits hanger combinations which will be found completely unique to the hunting industry.

As mentioned, the outermost component of the present hanger system, the outer receiver head, can be devised to receive most any form of primary gear. With regard to bow hunting applications, for example only, the bow hunting system includes a standard base mount and central link components as well as the following product heads: a single-arm bow hanger head, a triple-arm bow hanger head, and a bracketed universal quiver head. The system is made complete by an all-inclusive multi-purpose gear hook.

The two base components of the system are each oriented with a male mounting stud. The stud allows for central pipe components and/or head components to be directly applied. The central converter pipes are each oriented with a female receiver chuck as well as, when present, two separate mounting studs. The central pipe components can receive and/or mount to all system components. Each product head is oriented with a female receiver chuck. The chuck enables each head component to receive any base or central link component.

Traditional installation methods of screw style hangers are considered laborious due to the manual means in which the hanger is applied. Undoubtedly, starting the hanger's fixed screw is the first and most difficult step. The preliminary procedure usually requires a two-handed fastening mode. In that, one hand is used to steadily force the hanger against the tree, while the other hand rotates the hanger until it's screw is held. There is an added degree of difficulty when the hanger's attachment point is above the hunter's head.

The remaining screw shaft must now be turned completely into the tree. Certain hanger designs provide very little leverage to aid in the winding process, while others may be manipulated to ease the procedure. For example: a conventional hanger may supply additional leverage by adjusting the hanger's distal arm to a ninety degree position. Once in place, the hanger may be employed as a makeshift tool. Although this helps with installation, a substantial amount of manual labor must still be used. Installation is further complicated when nearby trees or limbs lie within the orbit of the distal arm; maneuvering around these obstacles adds even more time and inconvenience to an already tedious task.

Screw installations with the Applicant's hanger system allow for several unique advantages; all of which are attributed to the system's quick-release screw as more particularly described in Applicant's co-pending U.S. patent application Ser. No. 13/573,883 incorporated by reference herein. The primary advantage is that it enables the hunter to select a preferred method for installation; a choice made possible by the screw's capacity for use with various mechanical tools. Optional tool methods include: standard, powered, and ratchet styled tools. The present hanger system can also be applied by utilizing traditional installation methods. However, the use of mechanical tools not only simplify but accelerate the installation process. As compared to traditional methods, the Applicant's hanger system makes a step by step struggle a smooth uninterrupted event. In addition, most mechanical tools provide straight-drive capabilities which allow for screw deployments near an obstruction that may otherwise hinder the traditional winding process.

Further, the conventional screw style base mounts are predisposed to installation problems due to it's fixed base design. With certain designs, a screw shaft is simply cut from the solid metal bar which serves as the hanger's base. With other designs, a standard screw is placed at the end of a metal hanger tube and merely spot welded. Regardless of design, the screw often receives damage due to the substantial forces involved with the installation process. The resulting effect is usually loss of alignment to the screw or, in some cases, breakage of the screw. These common problems can make installation extremely difficult or render the hanger useless.

In comparison, Applicant's hanger system, in the screw in base mount 14 configuration, enables a damaged screw to be replaced quickly. In the event of a damaged screw, the hunter may simply disengage the screw from its designated drive source. A new screw can then be replaced and driven back into the tree. This unique concept decreases the odds of jeopardizing the hunt and more importantly eliminates the need to buy a new hanger unit. That is the screw in base mount 14 of the present invention includes the attachment shaft 18, the screw part, and the drive shaft in combination with the hang shaft, the mounting stud 24 all in one simple element.

The present hanger system is advantageous for permanent stand set-up due to the quick-release properties of its mountable screw, screw in base mount 14. Unlike fixed hanger products, the Applicant's hanger system allows the hunter to set countless trees with inexpensive screw in base mounts 14 or even strap to base mounts 16. Surplus screws greatly reduce the expense associated with permanent stand set-up. Furthermore, the detachable screw justifies the use of high end hanger products as opposed to low end versions which are commonly left to deteriorate in the field. In short, the present hanger system provides an innovative method for the advancement a well known hunting practice.

Further, at the conclusion of the hunt, the hunter may simply disconnect the other hanger elements, the central link(s) and the outer receiver head 26 and any performance devices 30, from its previously installed base screw or strap mount. The screw or strap to mount is left in the tree with only its weather treated stability plate and mounting stud exposed. Beginning with the next hunt, the hunter simply remounts the elements upon the mounting stud and the hanger system is now secured and readied for the hunt.

With regard specifically to strap to mounts, sporting goods companies also make available a diverse selection of strap style hanger products. Although less preferred than their screw style counterparts, strap style products prove practical because they inflict minor damage to the tree. For this reason, strap style products are a necessity for those who hunt public lands, tree farms, or other areas where screw style products are prohibited.

Traditional methods for installing strap style products prove awkward due to the hanger's fixed base design. The strap style process usually requires a two-handed fastening mode. In that, two hands are utilized to leash, bind, and clamp the hanger's strap around the tree, while a third body part is needed to counterbalance the extent of the hanger unit.

As set forth above, Applicant's hanger system can be easily modified to establish a strap style form. This unique option is attributed to the system's interchangeable strap to base mount 16. The quick-release mounting stud 24 also promotes a superior installation mode. In that, the strap to base mount is intended to be removed from the other hanger system elements and strapped independently to the tree. Once installed, the greater part of the hanger system assembly may then be applied. As compared to an otherwise clumsy technique, the Applicant's method relieves the hunter from shouldering the bulk of the entire hanger system assembly during the strap-to process.

In summary, it is Applicant's belief that the present hanger system and method innovates the systems and methods in which hanger devices are applied and thus, indeterminately warrants its use for any class of tree accessory product. Diverse examples include but are not limited to the following: shooting, rest, camera mounts, umbrellas, cover blinds, outdoor lights, scent dispensers, etc.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A hanger system comprising:

a. a base mount with a connection device conformed to connect with a separate object and wherein said base mount further includes a mounting stud conformed to fit within a female receiver wherein said mounting stud extends from said base mount;

b. an outer receiver head with a quick connect female receiver wherein said quick connect female receiver is conformed to connect with and disconnect from said mounting stud and when connected with said mounting stud to secure said mounting stud in place and wherein said outer receiver head includes a performance device; and c. a central link with a movable quick connect female receiver conformed to connect with and disconnect from said mounting stud and when connected with said mounting stud to secure said mounting stud in place and wherein said central link includes at least one mounting stud conformed to connect with said outer receiver head movable quick connect female receiver and wherein said central link includes a first mounting stud and a second mounting stud wherein said first mounting stud is located between said central link movable quick connect female receiver and said second mounting stud and wherein said first mounting stud extends perpendicular to said central link and wherein said outer receiver head movable quick connect female receiver is connected with said second mounting stud and wherein said second mounting stud extends parallel to said central link.

2. The system of claim 1 wherein said base mount is selected from a group consisting of: a screw in base mount with a screw connection device and with a mounting stud extending from said base mount and aligned with and directly opposite from said screw connection and a strap to base mount configured to be attached to said separate object with a strap and with a mounting stud extending from the center of said strap to base mount.

3. The system of claim 1 wherein said outer receiver head includes a performance device selected from a group consisting of: a bow hanger, a gear hook and a quiver holder.

4. The system of claim 3 wherein said outer receiver head includes a extended attachment arm configured to attach to a quiver holder.

5. The system of claim 3 wherein said bow hanger includes single, double or triple hooks.

6. The system of claim 1 wherein a performance device is connected with said central link first mounting stud.

7. The system of claim 1 further including a plurality of central links wherein one central link is connected with said base mount mounting stud and with another central link and wherein one central link is connected with said outer receiver head and with either the central link connected with said base mount mounting stud or another central link.

8. A hanger system comprising:

a. a base mount with a connection device conformed to connect with a separate object and wherein said base mount further includes a mounting stud conformed to fit within a female receiver wherein said mounting stud extends from said base mount and wherein said base mount is selected from group consisting of: a screw in base mount with a screw connection device and with a mounting stud extending from said base mount and aligned with and directly opposite from said screw connection and a strap to base mount configured to be attached to said separate object with a strap and with a mounting stud extending from the center of said strap to base mount;

b. an outer receiver head with a movable quick connect female receiver wherein said movable quick connect female receiver is conformed to connect with and disconnect from mounting stud and when connected with said mounting stud to secure said mounting stud in place and wherein said outer receiver head includes a performance device; and c. a central link also with a movable quick connect female receiver conformed to connect with and disconnect from said base mount mounting stud and when connected with said base mount mounting stud to secure said mounting stud in place and wherein said central link includes at least one mounting stud confirmed to connect with said outer receiver head movable quick connect female receiver and wherein said central link includes a first mounting stud and a second mounting stud wherein said first mounting stud is located between said central link movable quick connect female receiver and said second mounting stud and wherein said first mounting stud extends perpendicular to said central link and wherein said outer receiver head movable quick connect female receiver is connected with said second mounting stud.

9. The system of claim 8 wherein a performance device is connected with said central link first mounting stud.

10. The system of claim 8 further including a plurality of central links wherein one central link is connected with said base mount mounting stud and with another central link and wherein one central link is connected with said outer receiver head and with either the central link connected with said base mount mounting stud or another central link.

11. The system of claim 8 wherein said outer receiver head includes a performance device selected from a group consisting of: a bow hanger, a gear hook and a quiver bracket.

12. The system of claim 8 wherein either the central link or the outer receiver head includes an inner primary arm and an outer secondary arm wherein said outer secondary arm surrounds said inner primary arm and is movable to an extended position in which said inner primary arm is exposed and further wherein said outer secondary arm includes said performance device.

13. A hanger method consisting of:

a. providing a base mount with a connection device conformed to connect with a separate object and wherein said base mount further includes a mounting stud conformed to fit within a female receiver wherein said mounting stud extends from said base mount; and an outer receiver head with a movable quick connect female receiver wherein said movable quick connect female receiver is conformed to connect with and disconnect from said mounting stud and when connected with said mounting stud to secure said mounting stud in place and wherein said outer receiver head includes a performance device and further including a central link also with a movable quick connect female receiver conformed to connect with and disconnect from said base mount mounting stud and when connected with said base mount mounting stud to secure said mounting stud in place and wherein said central link includes at least one mounting stud conformed to connect with said outer receiver head movable quick connect female receiver and wherein said central link includes a first mounting stud and a second mounting stud wherein said first mounting stud is located between said central link movable quick connect female receiver and said second mounting stud and wherein said first mounting stud extends perpendicular to said central link and wherein said outer receiver head movable quick connect female receiver is connected with said second mounting stud and wherein said second mounting stud extends parallel to said central link; and b. attaching said base mount connection device to said separate object.

14. The method of claim 13 further including a plurality of central links wherein one central link is connected with said base mount mounting stud and with another central link and wherein one central link is connected with said outer receiver head and with either the central link connected with said base mount mounting stud or another central link.

15. The method of claim 13 wherein said outer receiver head includes a performance device selected from a group consisting of a bow hanger, a gear hook and a quiver bracket.

* * * * *